United States Patent [19]

Metelmann et al.

[11] Patent Number: 4,789,991

[45] Date of Patent: Dec. 6, 1988

[54] COOLING SYSTEM FOR ELECTRIC ARC FURNACES

[75] Inventors: Otto H. Metelmann, Wexford; Richard Prisalac, Library, both of Pa.

[73] Assignee: Mannesmann Aktiengesellschaft, Fed. Rep. of Germany

[21] Appl. No.: 145,605

[22] Filed: Jan. 19, 1988

[51] Int. Cl.[4] ..... F27D 1/02; F27D 1/12

[52] U.S. Cl. ..... 373/74

[58] Field of Search ..... 373/71, 73, 74, 75, 373/76, 158; 266/241; 432/233, 237, 238

[56] References Cited

U.S. PATENT DOCUMENTS 3,429,973 2/1969 Carter et al. ..... 373/74

4,301,320 11/1981 Hochstrasser et al. ..... 373/76

4,410,999 10/1983 Wabersich et al. ..... 373/76

4,491,952 1/1985 Honkaniemi et al. ..... 373/74

*Primary Examiner*—Roy N. Envall, Jr.

*Attorney, Agent, or Firm*—Schweitzer & Cornman

[57] ABSTRACT

An electric steel-making furnace with improved spray cooling features. Used spray coolant is disposed of, preferably after gravity removal from the furnace, by means of disc-type pumps, which can be operated continuously, even with a variable or discontinuous supply of exhaust coolant, at great savings compared to venturi-type pumps. Improved discharge outlet arrangements are provided to accommodate forward and rearward tilting movements of the furnace, as in the pouring off of slag and in the tapping of the molten steel product. These provisions may include a novel form of quick-disconnect fitting, to accommodate swinging away of the furnace roof for charging. Simple and efficient delta cooling means are also provided.

15 Claims, 6 Drawing Sheets

EXISTING MANIFOLD
VENT
10
11
12
13
14
15
43
44
45
46
47
48
49
50
51
52
53
54
70
71
111
112

COOLING SYSTEM FOR ELECTRIC ARC FURNACES

BACKGROUND AND SUMMARY OF THE INVENTION

The present invention relates to cooling systems, particularly for electric arc furnaces. It will be evident from the description, however, that many principles of the invention are applicable to other systems having substantial cooling requirements, such as induction furnaces, electro slag remelting furnaces, continuous strip casting procedures, and the like.

In the production of steel by way of electric arc furnaces, a charge of scrap steel is loaded into a melting vessel through an open top. The vessel is then closed by replacement of a removable roof, and large electrodes are inserted into the mass of scrap steel. When the electrodes are energized, the scrap charge is melted.

When an adequate volume of molten metal has been developed within the vessel, it is tapped, typically by tilting of the vessel, to remove the molten metal charge. Thereafter, the furnace roof is swung aside to allow a new charge of scrap metal to be loaded. Additional scrap metal charges typically will be added during the melting process, during which, of course, the roof is swung aside to provide charging access by way of an overhead crane.

Because of the periodic removal of the roof, and also because of the "batch" character of the operation, both the roof and the furnace vessel are subjected not only to extremely high temperatures, but also to extremes of temperature cycling. As a means of reducing the high levels of temperature stress on the components of the furnace, it has become increasingly common to utilize active water cooling of the roof and walls of the furnace. Particularly the roof, and the portion of the vessel walls above the level of the molten metal are often constructed without the use of manufactured refractories, relying upon effective water cooling and a minor amount of insulation resulting from slag accumulation on the exposed surfaces. One widely used system for the water cooling of electric arc furnace walls is represented by the Zangs U.S. Pat. No. 4,207,060, and known commercially as the Demag TW-2000 System.

More recently, efforts have been made to reduce the water flow requirements of furnace cooling systems, by utilizing spray cooling procedures, such as have been used in the past in connection with the cooling of blast furnaces, for example. Such spray cooling systems have also been proposed for electro slag remelting vessels, induction furnaces and smelting cupolas, among others.

One form of spray cooling system proposed for electric arc furnaces in particular is reflected in West German Patent Publication No. 3,027,465, granted to Korf Stahl A.G. In the system of the Korf patent, the spray coolant is intended to be mostly converted to steam. The steam coolant is continuously evacuated from the vessel walls, condensed and reused. Condensate is also collected, presumably by gravity, and recycled. A similar system is illustrated in the Heggart et al. U.S. Pat. No. 4,715,042, granted to Union Carbide Corporation. In the Union Carbide system, the spray cooled vessel walls are continuously evacuated by means of venturi exhaust pumps, in order to prevent the buildup of steam pressure and/or excessive condensate within the vessel walls.

The system of the present invention provides for the spray cooling of vessel walls, particularly the roof and sidewall areas of an electric arc steel-making furnace or the like, which incorporates significant improvements over the systems proposed by the Korf and/or Union Carbide patents. In one important respect, the system of the invention incorporates significant improvements in the manner in which used spray coolant is disposed of. In the system of the present invention, the flow of spray coolant onto the vessel walls, is carried out at a relatively high rate of flow, so as, to a great extent, to avoid generation of steam. Provisions are made for the collection and disposal of the used coolant, preferably although not critically by gravity flow from the vessel walls. Significant to the invention, however, is the provision of motor-driven, disc-type pumps, which are operated substantially continuously during normal operations of the furnace and serve to remove the collected used coolant, either for recycling or for disposal, depending upon environmental and other conditions. The use of motor-driven disc-type pumps is significant, because such pumps can be operated continuously, regardless of the presence or absence of a supply of coolant. In general, mechanical pumps such as positive displacement pumps or conventional centrifugal pumps used for this purpose would quickly disintegrate if allowed to run in a "dry" condition.

By way of contrast, in the Union Carbide patent, a venturi evacuation pump system is employed, which can operate continuously without ill effect from the absence of coolant at its intake. However, the continuous operation of such pumps is extremely costly in terms of energy useage. And while the Union Carbide patent represents that the venturi evacuation system utilizes for its operation water which is otherwise available in the plant, that does not reveal the fact that such water must be substantially pressurized, up to perhaps 60 psi, in order to be effectively activate the venturi pumps. The energy required for such pressurization is extremely costly in comparison to, for example, the system of the applicant's invention, even though, technically speaking, the supply of water may be otherwise "available" for the using.

In accordance with a further feature of the invention, advantageous structural provisions are made for the continuous effective removal of used spray coolant during the forward and rearward tilting orientations of the furnace vessel, during deslagging operations and during tapping of the molten steel product. In this respect, at one or more times during a given batch operation, the furnace vessel may be tilted to the rear to enable removal of excessive slag from the surface of the molten metal. During this tilting operation, collected used coolant will tend to flow by gravity to the lowest point of the confined chamber. In the case of a spray cooled roof, such coolant will collect at the low side of the roof. Subsequently, when the molten metal batch is tapped off, the furnace vessel is tilted in the opposite or forward direction, and the coolant, which continues to be sprayed during these operations, collects at the forward side of the roof.

In accordance with one specific feature of the invention, a spray cooled roof is constructed with an internal duct extending from the front to the back sides, and connected to a pair of separate discharge outlets at one side, preferably the forward side. The discharge outlets, isolated from each other, communicate with opposite ends of the internal duct, so that in any tilted position of the vessel, used coolant can be removed.

In another advantageous form of the invention, discharge conduits, in the form of flexible hoses, are connected separately to the front and back sides of the roof and/or vessel. In any tilted orientation of the vessel, one of the discharge ducts will be connected to the low side for effective continuous outflow of the used coolant.

In an electric arc furnace, provisions typically are made for swinging aside of the roof, to provide overhead access to the vessel for charging with an overhead crane. The swinging axis of the roof typically is a vertical axis offset to one side of the furnace vessel. Particularly with respect to the last mentioned embodiment of the invention, the invention further provides for the quick-disconnect coupling of at least one of the discharge hoses, to allow the roof to be swung away from the vessel. The coupling advantageously incorporates a fluid actuator arranged, when the furnace roof is in its closed position to move the discharge hose into coupled relation with a discharge outlet on the roof. A normally closed valve member, mounted in the discharge outlet of the roof is automatically opened upon joining of the quick-disconnect coupling means.

In accordance with still another aspect of the invention, a simplified and advantageous arrangement is provided for cooling of the so-called delta section of a roof, utilizing forced circulation cooling of the delta in conjunction with spray cooling of the main body of the roof. To advantage, the exhaust coolant, from the forced circulation delta cooling system, is routed into one or more of the discharge outlets for the roof, from where it flows by gravity to the sump area.

For a more complete understanding of the above and other features and advantages of the invention, reference should be made to the following detailed description of preferred embodiments of the invention and to the accompanying drawings.

DESCRIPTION OF PREFERRED EMBODIMENTS

Figures 1, 2, 3:
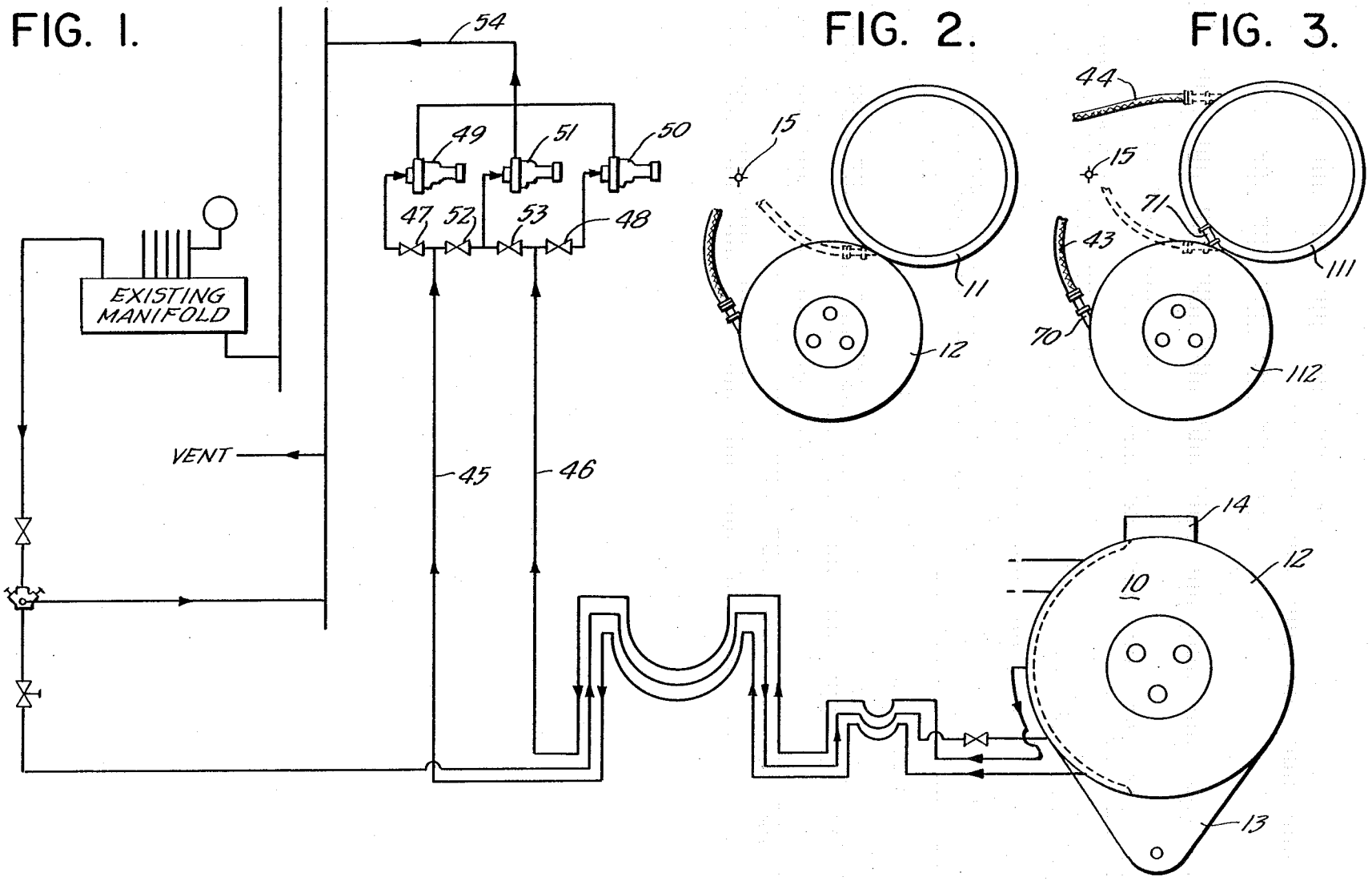
FIG. 1 is a highly schematic illustration of an electric furnace provided with a spray cooling system and an improved system according to the invention for disposal of the used coolant.
FIG. 2 is a simplified top plan view of the electric furnace shown in FIG. 1, with the roof thereof swung to an open position for charging of the furnace vessel.
FIG. 3 is a view, similar to FIG. 2, illustrating a modified form of system for disposal of the used spray coolant from the furnace roof.
Figure 5:
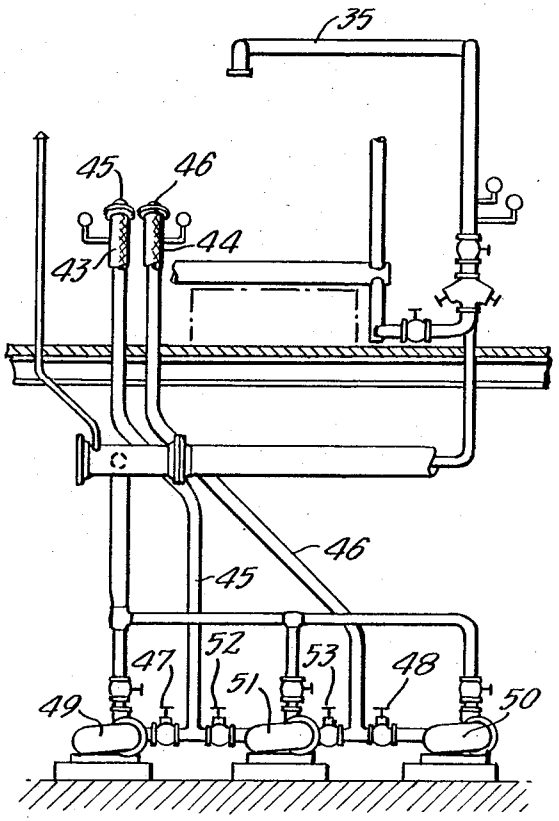
FIG. 5 is an end elevational view of the system shown in FIG. 4.

Referring now to the drawing, the reference numeral 10 (FIG. 1) designates in a general way an electric arc furnace comprising an open top furnace vessel 11 and roof 12. The vessel 11 is provided with tapping spouts 13, 14 at the front and rear sides respectively, for the tapping of molten steel and slag.

In the operation of an electric arc furnace, the roof 12 is swung aside to accommodate charging of the open top vessel 11 by means of an overhead crane (not shown). Support structure for the roof 12 accommodates pivoting movement of the roof about a vertical axis 15 (FIG. 2) offset to one side of the furnace vessel.

The present invention is directed to improvements in facilities for the spray cooling of the roof 12. It will be understood, however, that many principles of the invention will be applicable for the cooling of the vessel sidewalls, for example, and/or for the cooling of other apparatus subject to high temperature operation, such as induction furnaces, systems for the continuous casting of steel billets, and the like.

Figure 12:
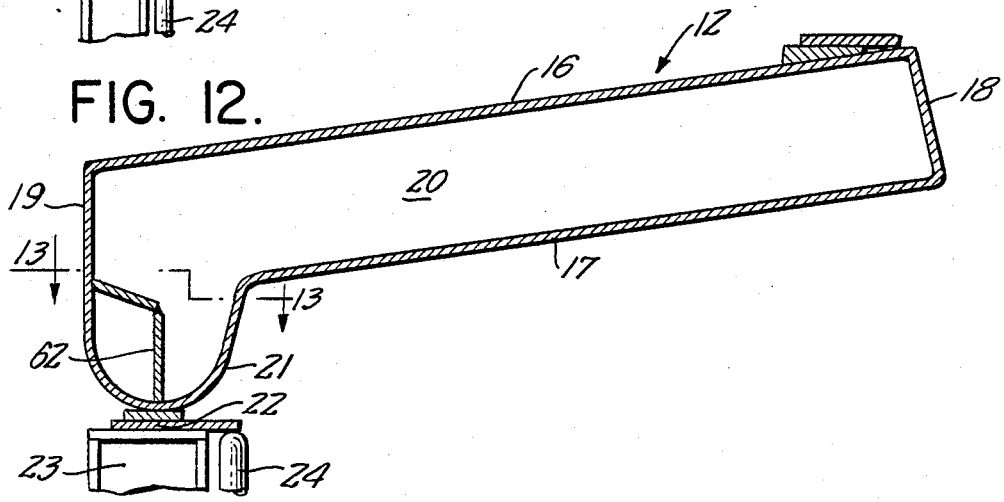
FIG. 12 is an enlarged, fragmentary cross sectional view of the roof section of FIG. 11.

With respect to FIGS. 9–13, the furnace roof 12 is shown to be of hollow construction, having steel plates forming spaced upper and lower walls 16, 17 and inner and outer sidewalls 18, 19, these walls among them defining a hollow internal chamber 20 (see particularly FIG. 12). In accordance with the invention, the roof structure is provided about its outer peripheral edge with a deep, U-shaped catchment ring 21, which communicates with but extends well below the main roof chamber 20. The bottom portion of the peripheral catchment is supported upon the upper plates 22 of the furnace sidewall structure 23. In the illustrated arrangement, the sidewall is formed of panels 24 constructed of tubular sections placed side by side, substantially in accordance with the principles of the Zangs U.S. Pat. No. 4,207,060, in the region above the level of molten metal in the vessel. It will be understood, of course, that the upper sidewall portions of the vessel may also be of hollow construction, similar to the roof 12, if desired.

In accordance with conventional arc furnace construction, a so-called delta structure 25 is mounted in a central opening in the furnace roof. The delta structure accommodates the mounting of large cylindrical electrodes 26 which project into the main body of the vessel in accordance with known practice.

Figure 4:
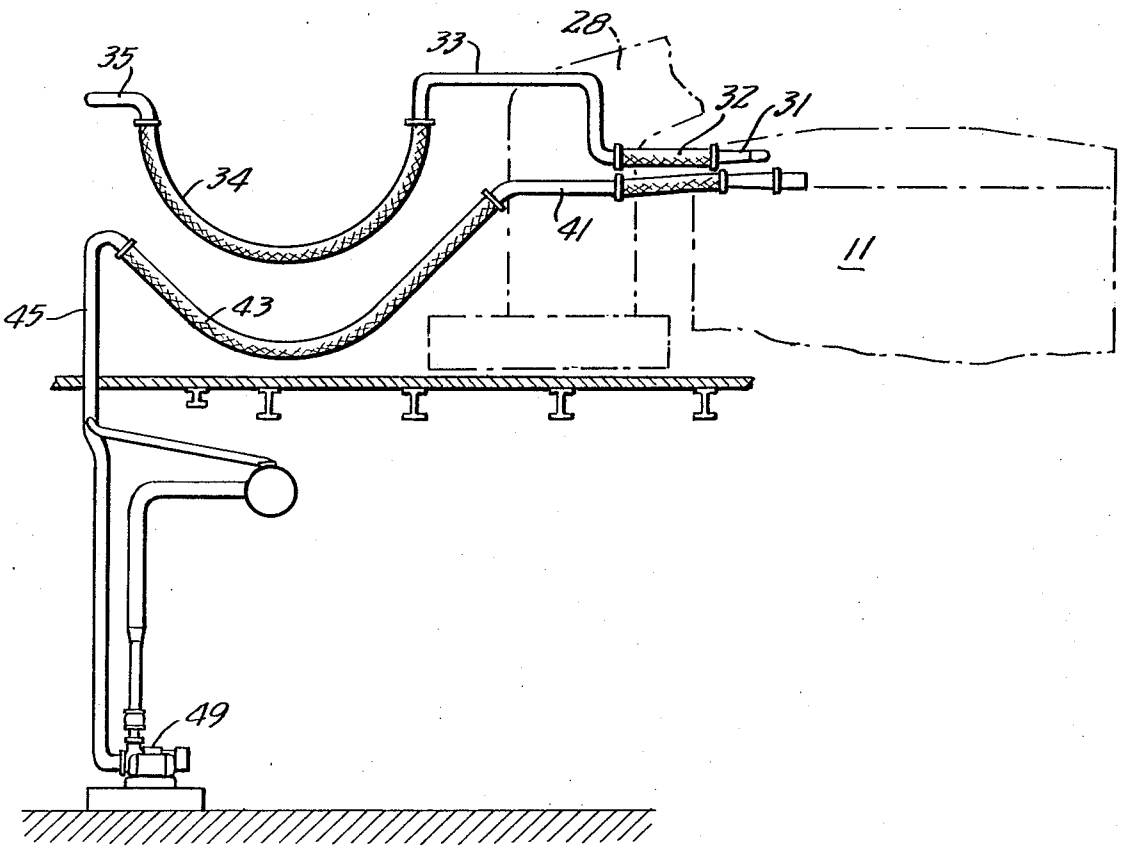
FIG. 4 is a simplified side elevational view, partly in section, illustrating duct and tubing connections for the coolant disposal system according to the invention.
Figure 9:
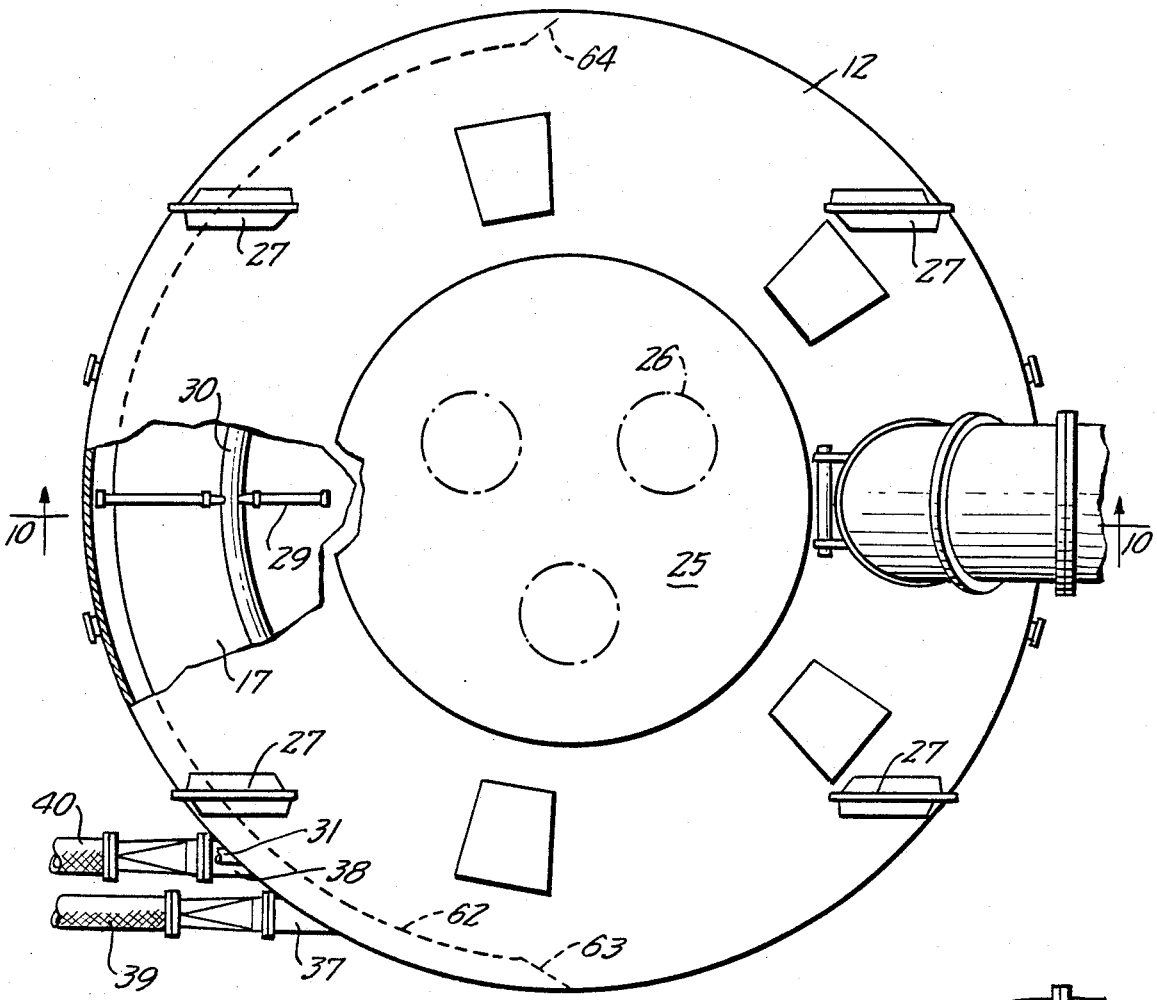
FIG. 9 is a top plan view of a roof construction for the furnace of FIG. 1, illustrating certain details of the coolant removal system of the invention.

As reflected in FIG. 9, the roof 12 is provided with a plurality of support brackets 27 by which the roof is secured to its external support structure 28 (FIG. 4). During melting operations of the furnace, the roof 12 is supported upon and by the sidewall support structure 23. For charging operations, however, the roof can be lifted slightly by the support structure 28 and pivoted by such support structure to a position as shown in FIG. 2, all in accordance with well known procedure.

Cooling of the furnace roof 12 is accomplished by spray cooling means in the form of spray pipes 29 arranged about the interior of the roof chamber 20 in a manner to direct sprays of cooling water against the lower wall 17. In the illustrated arrangement, there is provided a central circular header pipe 30 which extends about the roof and connects at a plurality of locations with the spray pipes 29, which are generally radially oriented.

The header 30 is supplied with water under pressure through a supply inlet fitting 31. The fitting 31 is connected through a short flexible hose segment 32 to a pipe section 33 mounted in fixed relation to the furnace vessel 11. The fixed pipe section 33 is in turn connected through a flexible hose loop 34 to the pressurized water supply 35. The flexible hose loop 34 accommodates tilting of the furnace vessel 11, relative to the fixed supply pipe 35, during pouring of slag and tapping of the steel output.

In the water cooling of the roof 12, cooling water is employed, which must be properly disposed of, either by way of discharge or direction to a holding facility for eventual recirculation.

Figure 10:
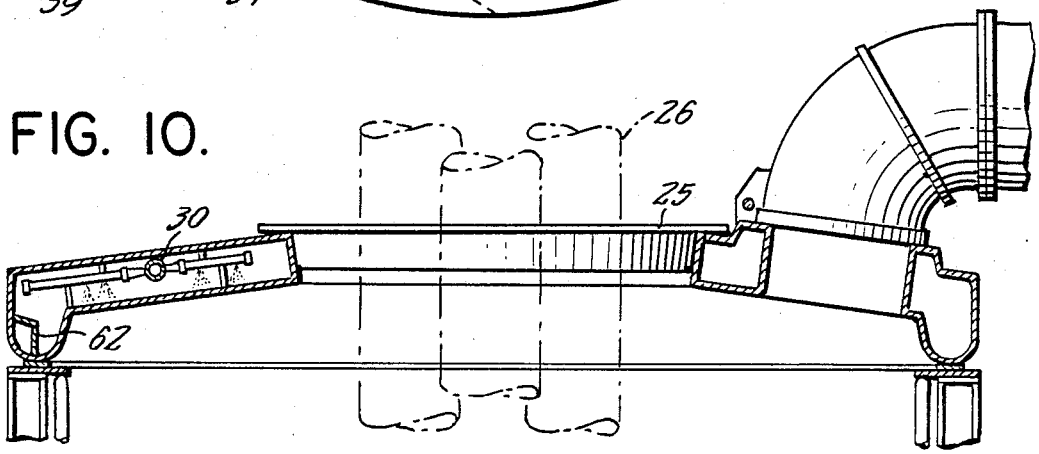
FIG. 10 is a cross sectional view as taken generally on line 10—10 of FIG. 9.
Figure 11:
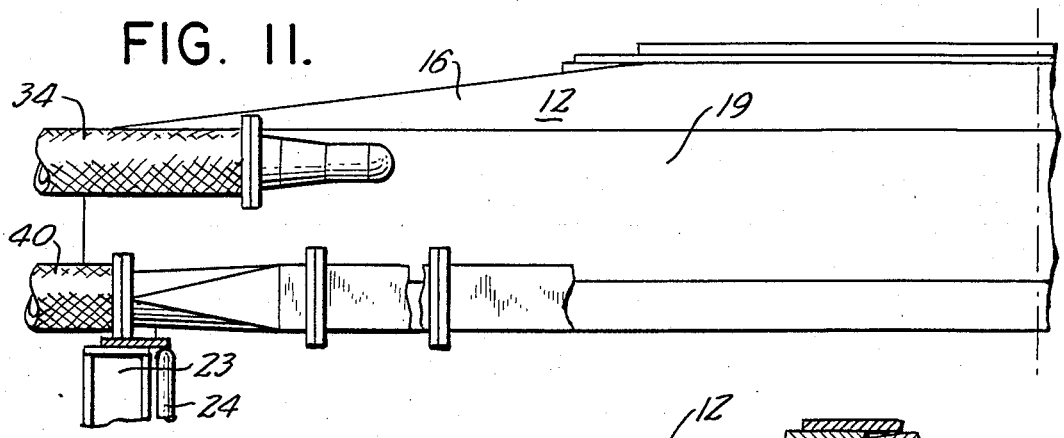
FIG. 11 is an enlarged, fragmentary elevational view of the furnace roof shown in FIG. 9, showing additional details of the coolant disposal system.

As reflected in FIGS. 10 and 12, the structure of the roof 12 slopes outwardly, toward the peripheral catchment 21. As a result, the spray coolant, after being impinged against the bottom wall 17, quickly flows by gravity toward and into the catchment. In this respect, the rate of application of the cooling sprays by the pipes 29 is designed to be such as to substantially prevent the formation of steam within the roof chamber 20 while at the same time substantially avoiding the formation of a heavy, continuous film of water on the bottom wall 17. To this end, it is known to position thermocouples or other temperature sensing devices strategically within the roof chamber, to monitor the temperature of the wall 17 and to control the discharge of spray coolant accordingly. Such control may be on the basis of predetermined zones or sectors of the roof, or in special cases, control over individual spray pipes or spray nozzles may be provided, all as is known in the art. In any instance, it is contemplated that the discharge of spray coolant into the roof chamber 20 may be a significant variable, as a function of roof temperature. The present invention thus specifically contemplates that the discharge of spray coolant may be of a highly variable nature.

In accordance with one aspect of the invention, disposal of the used coolant fluid is achieved by means of a specific type of pump, namely a so-call "Discflo" pump as marketed at the time of filing hereof by Discflo Corporation, Sante, California. A typical construction of such a pump is reflected in U.S. Pat. Nos. 1,061,142 and 4,335,994, for example, which are incorporated herein by reference. The Discflo pump is uniquely advantageous for the specific application herein described, in that it may be continuously motor-driven during normal operations of the steel-making furnace, without excessive energy costs and without damage to the pump. Normal motor-driven mechanical pumps, such as positive displacement or centrifugal pumps, in order to be continuously operated, typically must be provided with a constant supply of liquid at the intake. If allowed to run dry, the pumps are quickly destroyed. The Discflo pump, on the other hand, can be driven continuously in a dry condition without damage.

Heretofore it has been proposed to utilize a venturi-type suction device for evacuating the interior of a spray cooled furnace roof. Such proposal forms the basis of the Heggart et al. U.S. Pat. No. 4,715,042, granted Dec. 22, 1987. While the venturi-type pump can be continuously operated on a "dry" basis, that is without any supply of used coolant liquid from the furnace roof, the energy costs of operating a venturi-type pump are extremely high. The operating costs of venturi-type pumps are sufficiently excessive, in fact, that the savings otherwise available from spray cooling, vis-a-vis forced circulation cooling, may be largely if not entirely dissipated by the expense of operating the venturi pumps. And the fact that the venturi pump is operated with water "otherwise available" does not avoid the excessive energy consumption, because it is necessary in any event to elevate the pressure of the water significantly for it to operate effectively in a venturi pump system. By specific selection of the Discflo-type pump, on the other hand, the present invention enables amotor-driven pump to be operated, at a very modest energy cost, particularly when running dry or partially dry, yet the motor-driven pump is not damaged by running in a dry or partially dry condition for extended periods.

In the illustrated arrangement, the furnace roof is provided with a pair of discharge outlet connections 37, 38 (see FIG. 13), the purpose of which will be described. These discharge outlets are joined through short flexible hoses 39, 40 (FIG. 9) to fixed pipe sections 41, 42 which are mounted in fixed relation to the roof support 28, for swinging movement with the roof and support when the furnace is opened for charging, and for tilting movement with the furnace during slag-off or steel tapping operations.

Each of the pipe sections 41, 42 is connected to a hose loop 43, 44 and thence to fixed discharge pipes 45, 46.

As shown schematically in FIG. 1, the respective discharge pipes 45, 46 are connected through valves 47, 48 to respective motor-driven Discflo pumps 49, 50. In a typical commercial installation, a third motor-driven Discflo pump 51 is provided, with valves 52, 53 selectively connectable to the discharge pipes 45, 46. The pump 51 is provided for standby operation and can be connected to either of the lines 45, 46 in the event of a malfunction of the pumps 49 or 50.

To particular advantage, the discharge pipes 45, 46 at their highest points are located well below the lowest points of the roof catchment 21. In addition, the discharge outlets 37, 38, connecting hoses 39, 40 and pipe sections 41, 42 are all arranged with a downward incline from the peripheral catchment 21, so that there is a natural gravity flow of used spray coolant from the furnace roof. The used coolant thus naturally flows by gravity to the intake sumps of the respective pumps 49, 50. The coolant, to the extent that it is available at the intake sumps, is pumped away through a common discharge line 54, for collection and/or reuse as appropriate and desired.

Figure 6:
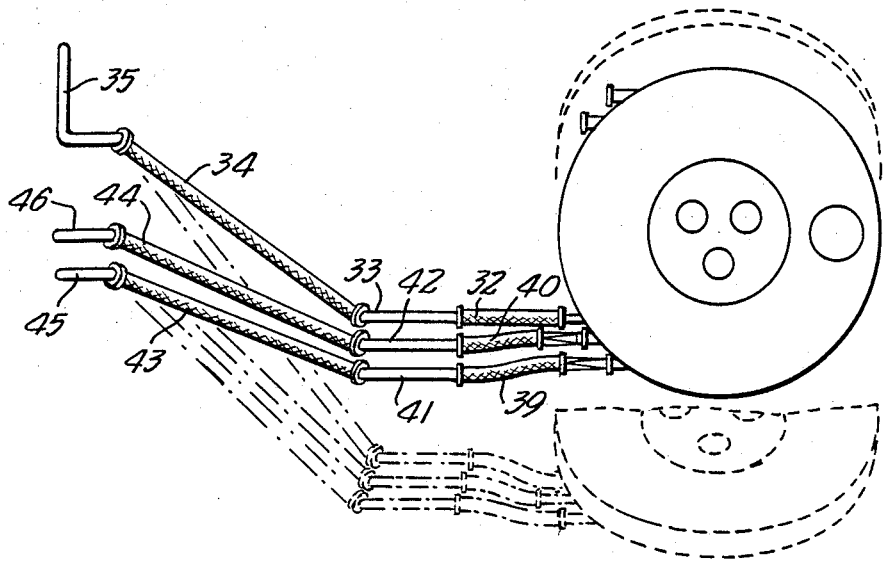
FIG. 6 is a simplified top plan view of the electric furnace of FIG. 1, illustrating the furnace in its normal operating position, and also illustrating in dotted lines the position of the furnace in the forwardly and rearwardly tilted positions for tapping respectively of steel and slag.
Figure 7:
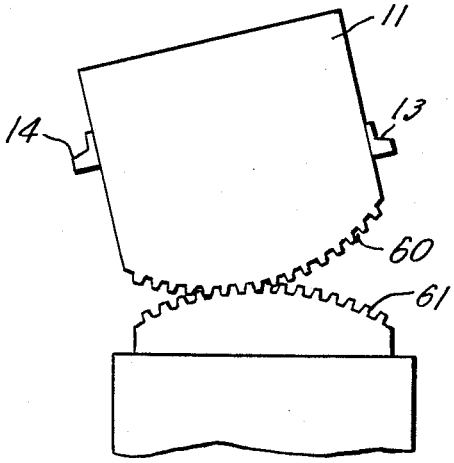
FIGS. 7 and 8 are simplified, schematic elevational views of the furnace vessel, illustrating it in positions for, respectively, pouring of slag and tapping of steel.
Figure 8:
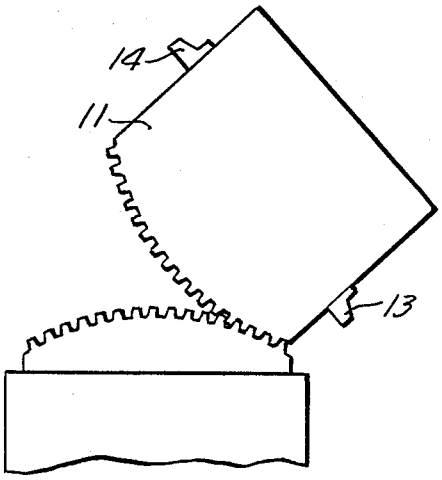

As is reflected schematically in FIGS. 6–8, a typical electric arc furnace is mounted in a manner to be rocked forwardly, as shown in FIG. 8, or rearwardly, as shown in FIG. 7 to enable tapping of the molten steel from the forward spout 13 or removal of slag from the rear spout 14. In a typical structure, the furnace vessel 11 is provided with an arcuate base 60 mounted on an arcuate support 61, so that forward and rearward rocking of the vessel is accompanied by a certain amount of forward and rearward translation. All of the hose loops 34 and 43, 44 are designed to be sufficiently long to accommodate such motion.

Figure 13:
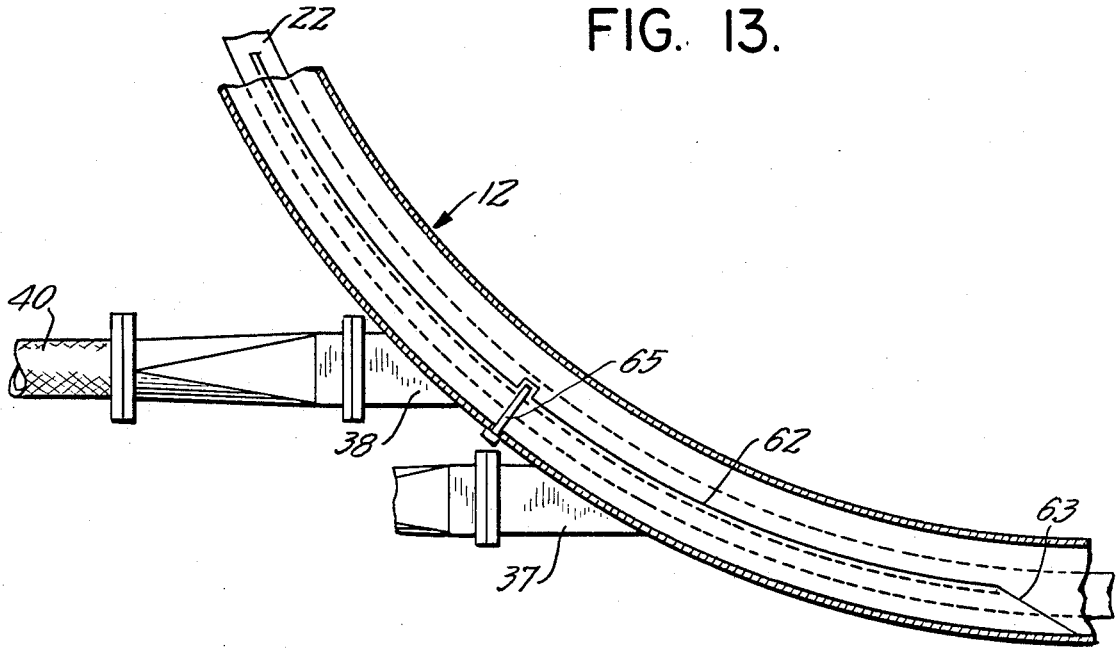
FIG. 13 is a fragmentary, cross sectional view as taken generally along line 13—13 of FIG. 12.

As will be appreciated, during the brief periods when the furnace is tilted, either forwardly or rearwardly, the coolant will drain by gravity either toward the front of the roof or toward the back. Continued removal of liquid during these moments is accomplished, according to the invention, by alternative systems. The first such system involves the provision of a tubular duct 62 constructed within the peripheral catchment 21 and extending around the side of the roof nearest the discharge outlet, substantially from the front extremity to the rear extremity. The tubular duct is closed throughout its length, open at its forward and rearward end extremities 63, 64 and closed off between the respective discharge outlets 37, 38 by a dividing plate 65 (FIG. 13). During normal operations of the furnace, when the roof is level, used spray coolant flows by gravity into the peripheral catchment 21 and from the catchment into the opposite ends 63, 64 of the tubular duct. That fraction of the liquid flowing into the front end 63 of the duct flows from the discharge outlet 37, while the coolant liquid entering the duct from the rear end 64 flows through the duct and out through the discharge outlet 38.

As indicated in the schematic diagram of FIG. 1, the two discharge outlets 37, 38 are in lines which are isolated from each other, each having a separate discharge pipe 45, 46 leading to the intake of a pump 49 or 50. Accordingly, when the furnace is tilted in its rearward direction, for slag removal, used spray coolant collects at the rearward side of the roof and enters the rearward portion of the tubular duct 62, through its rearward open end 64. Such coolant flows outward exclusively through the discharge outlet 38. No coolant whatever is reaching the forward end 63 of the tubular duct during this period, and its pump will thus quickly exhaust its inlet sump and run dry. The operation of the furnace is not affected, as all of the used coolant is removed through the discharge outlet 38. When the furnace is tilted in the forward direction, for tapping of the molten steel, the reverse condition will prevail. All of the spray coolant being removed through the forward discharge outlet 37, while the discharge outlet 38 does dry.

Figure 14:
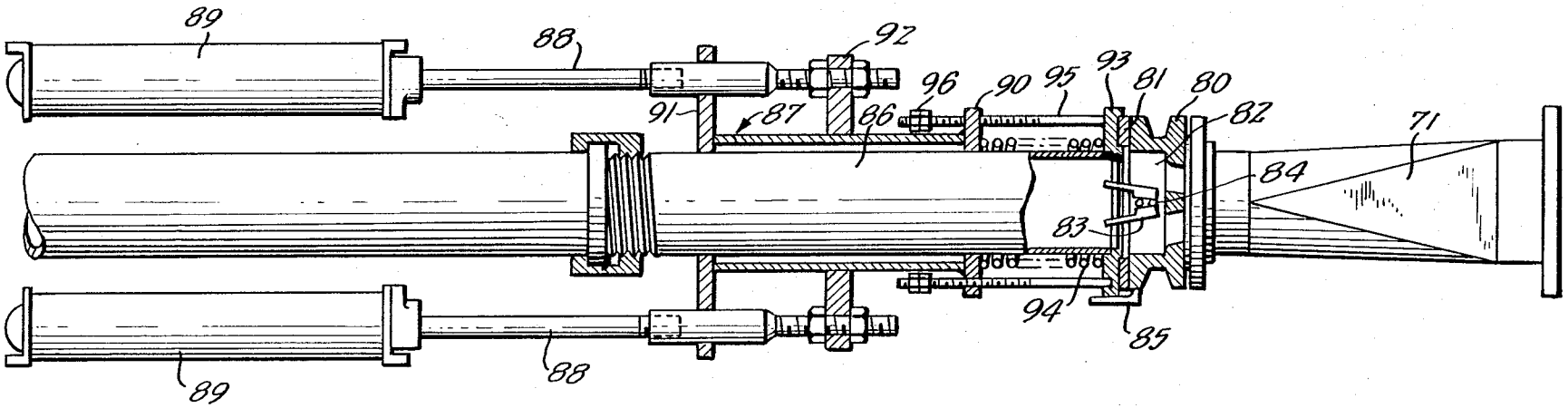
FIG. 14 is an enlarged, fragmentary view, partly in section, showing an advantageous form of quick-disconnect coupling arrangement which may be employed in one of the modifications of the invention.
Figure 15:
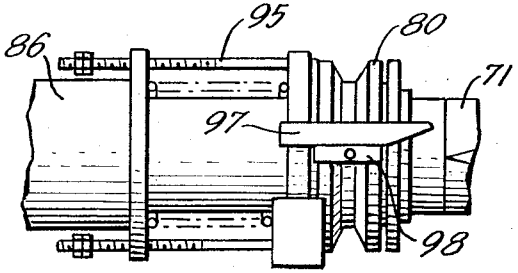
FIG. 15 is a fragmentary view of a valve operating mechanism employed in the coupling device of FIG. 14.

In a modified form of the invention, illustrated schematically in FIG. 3, with additional details shown in FIGS. 14 and 15, provision is made for locating discharge outlets 70, 71 at the respective forward and rearward sides of the roof 72, 112. Each of these discharge outlets is normally connected to a discharge hose 43, 44 leading to disposal areas. When the vessel, designated in FIG. 3 by the numeral 111, is tilted rearwardly for pouring off of slag, the rear-side coolant discharge outlet 71 is operative, whereas the front-side discharge outlet 70 is operative when the furnace is tilted forwardly for tapping of the steel. During normal melting operations, when the vessel is horizontally oriented, both discharge outlets are functional.

During charging of the furnace vessel, when the roof 112 must be swung aside on its vertical pivot axis 15, as shown in FIG. 3, the presence of the roof support structure (see item 28, FIG. 4) would interfere with the swinging of the rear-side flexible hose 44. Accordingly, provision is made for a novel and simplified quick-disconnect coupling arrangement for automatically connecting and disconnecting the discharge outlet 71 from its discharge hose when the roof 112 is swung to its open or closed position, as the case may be. With reference to FIGS. 14, 15, the discharge outlet 71 is provided at its outer extremity with a coupling collar 80 provided on its outer face with an annular sealing gasket 81. A central passage 82 through the coupling collar has pivotally mounted therein a pair of semicircular flap valve elements 83 pivoted about a central axis 84. In FIG. 14, the valve flaps 83 are shown in the open position. When pivoted to a closed position, the flaps form a circular disc, effectively closing off the through passage 82 of the coupling collar. Desirably, the coupling collar has mounted around its lower portion a coupling guide 85, which is arranged to guide and support the opposite portion of the coupling device.

Aligned with the discharge outlet 71 is a coupling tube 86, which is mounted for limited axial movement within a guide frame 87 carried by the actuating rods 88 of a pair of hydraulic cylinders 89. The cylinders 89 are rigidly supported on the tilt floor of the furnace vessel, so as to have a fixed relation to the furnace.

The guide frame 87 includes front and rear guide plates 90, 91 slideably receiving the coupling tube 86. The frame is connected to the cylinder actuating rods 88 by means of a flange 92.

At the forward extremity of the coupling tube 86 there is fixed a forwardly facing coupling ring 93. The ring 93 is provided with a forwardly facing channel arranged to receive and form a fluid-type connection with the annular gasket 81 mounted on the coupling collar 80.

A compressible coil spring 94 extends between the coupling ring 93 and the front guide collar 90, constantly urging the ring and the coupling tube 86 in a forward direction. The forward movement of the tube and ring is limited, however, by a plurality of bolts 95 extending from the ring 93, through openings in the guide collar 90 and carrying stop nuts 96.

In order to disconnect the coupling with the discharge outlet 71, the fluid cylinders 89 are retracted, retracting the coupling ring 93 from the coupling collar 80. A connecting operation is simply the reverse. The cylinders are actuated to extend, bringing the ring and coupling collar into face to face contact. Continued extension of the actuator rods 88 advances the guide frame 87, placing the spring 94 under further compression, so that the coupling is maintained as a function of the spring pressure.

The valve flaps 83 are normally urged to a closed position, by spring means (not shown). Opening of the valve flaps is effected automatically upon joining of the coupling parts, by means of a cam 97, carried by the coupling 93, and an actuating lever 98 carried at the end of the pivot mounting 84 for the valve flaps. When the coupling parts are separated, the lever 98 is disposed transverse to the axis of the discharge outlet, causing one of the valve flaps to be moved to a transverse position by rotation of the pivot rod 84. The companion valve flap is appropriately geared or otherwise mechanically connected to its partner, so that both flaps are driven to open or closed positions simultaneously and symmetrically. When the coupling parts are joined, as shown in FIG. 15, the cam 97 forces the level 98 to rotate into alignment, causing the valve flaps 83 to be pivoted to their open positions, as shown in FIG. 14.

Figure 16:
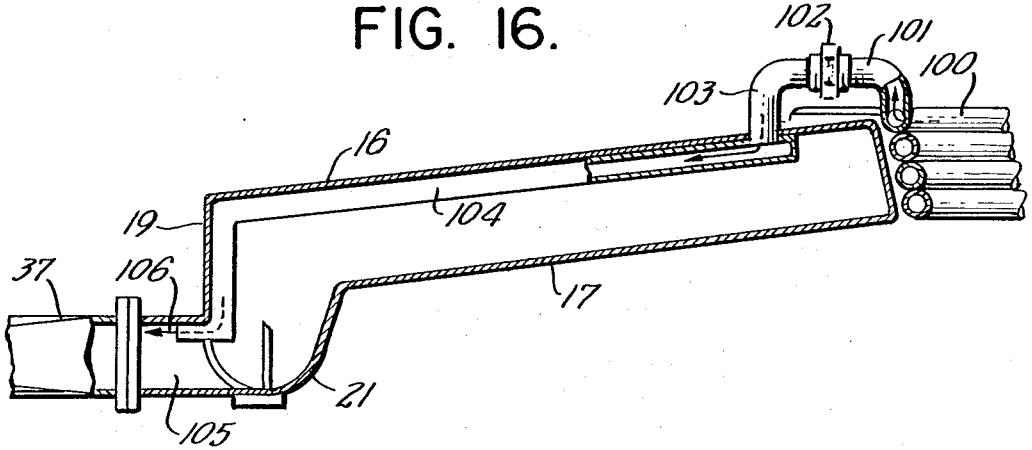
FIG. 16 is a fragmentary, cross sectional view, similar to FIG. 12, illustrating an advantageous arrangement for exhausting of cooling water from the delta section of the furnace roof.

In an electric arc furnace of typical design, separate structure and separate cooling arrangements are provided for the delta section 25. In the illustrated apparatus, while the roof structure in general is cooled by spray cooling techniques, it is preferred to utilize forced circulation cooling techniques for the delta section. With reference particularly to FIG. 16, delta cooling means are schematically illustrated in the form of coils 100 supplied at one end (not shown) with cooling water under pressure. In accordance with the invention, the discharge of the used coolant is provided for through one of the discharge outlets 37 connected to the main roof structure and provided for the disposal of exhaust spray coolant from the roof. To this end, the discharge end 101 of the delta cooling coil is connected through a union joint 102 which can also be a flexible connection, to an elbow 103 connected to a duct 104 mounted on the upper wall 16 of the furnace roof. The duct 104 extends radially to the edge of the upper wall 16, then downward along the outer wall 19 and then outward at least a short distance into the entry passage 105 of the discharge outlet 37. Desirably, the discharge end 106 of the duct 104 is located slightly downstream of the point where the discharge outlet 37 joins with the peripheral catchment 21, so as both to avoid adding to the volume of liquid in the catchment and, perhaps in some small measure, assisting the outflow of coolant through the discharge outlet.

It should be particularly understood that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. In an electric arc furnace of the type having an open top vessel, a removable roof structure, a temperature responsive variable rate spray cooling system for at least selected portions of said furnace, and means for disposing of the spray coolant from said spray cooling system, the improvement in said disposing means characterized by (a) said selected furnace portions being provided with discharge outlet means for the gravity discharge of spray coolant, (b) discharge duct means connected to said discharge outlet means for leading said spray coolant away from said discharge outlet means by gravity, (c) a coolant disposal pump connected to said discharge duct means and located substantially below said discharge outlet, (d) said disposal pump being of a motor driven rotating disc type, with the discs thereof being in direct contact with spray coolant from said discharge duct means, (e) motor means for driving said pump susbtantially continuously during normal operations of said furnace.

2. The improvement of claim 1, further characterized by (a) said discharge outlet means comprising at least two outlets, (b) separate discharge lines leading from each of said outlets, and (c) separate disc-type pumps connected to said separate discharge lines.

3. The improvement of claim 2, further characterized by (a) said movable roof structure being mounted for pivoting movement about a vertical axis offset from said furnace, (b) said separate discharge lines being connected to said roof structure on opposite sides of said vertical axis, (c) one of said discharge lines being detachable to accommodate pivoting movement of said roof.

4. In a spray cooling system for an electric steel melting furnace of the type having a variable rate spray cooling system operated in accordance with temperature conditions, and a system for disposal of the spray coolant, the improvement, in said disposal system which comprises, (a) discharge outlet means positioned to receive collected spray coolant, (b) disc-type pump means connected to said outlet means and having rotary discs arranged for direct contact of said collected spray coolant, and (c) means for driving said pump means substantially continuously during normal operations of said furnace.

5. The improvement of claim 4, further characterized by (a) said discharge outlet means being located substantially above said pump means to enable a gravity flow of collected coolant to said pump means.

6. In a roof structure for a tiltable electric arc furnace of the type having a spray cooling system for at least the roof thereof, discharge outlet means at a side edge of said roof structure, and a pump system for disposing of collected spray coolant, the improvement characterized by (a) said roof structure being provided with a peripheral catchment for receiving spray coolant discharged within said structure, (b) said furnace being tiltable in forward and rearward directions, for removal of slag on one side, and for tapping of steel on the other side, (c) said discharge outlet means being located toward the forward side of said furnace, (d) a tubular duct formed in part by said peripheral catchment and extending around at least one side of said roof structure from the forward side to the rearward side of said roof structure, (e) said discharge outlet means comprising separate, isolated outlets connected at closely spaced points to said roof structure, (f) at least one of said isolated outlets being connected to said tubular duct at a location remote from the rearward side of the furnace, (g) said tubular duct being closed on the side of said one isolated outlet toward the forward side of said furnace, (h) the other of said isolated outlets being connected to said catchment means on the forward side of the closed portion of said duct means.

7. The improvement of claim 6, further characterized by (a) said tubular duct extending from the forward side of said furnace to its rearward side, (b) said tubular duct being open at both ends and closed between said isolated outlets.

8. The improvement of claim 6, further characterized by (a) separate pumps connected to said isolated outlets.

9. In an electric steel melting furnace of the type having a bi-directionally tiltable steel-making vessel, a roof swingable about a vertical axis offset from the vessel, a spray cooling system for said roof, and means for disposing of spray coolant, the improvement in said disposing means characterized by (a) said roof having first and second discharge outlets, spaced substantially apart, one toward each side of the furnace to which the furnace vessel tilts and on each side of said vertical axis, (b) said roof being swingable to a predetermined side of said vessel to open the top of said vessel for charging, (c) first and second flexible discharge hoses connected to the respective first and second discharge outlets, and (d) quick-disconnect coupling means for connecting the first discharge outlet, located on the side of said furnace opposite said predetermined side to accommodate swinging open of said roof.

10. The improvement of claim 9, further characterized by (a) said disposing means further comprising fixed conduit means connected to the downstream ends of said flexible discharge hoses, (b) said quick-disconnect coupling means comprising a coupling support mounted for tilting movement with said vessel, (c) actuating cylinder means mounted on said support (d) a member controllably movable by said actuating cylinder toward and away from said first discharge outlet when said roof is in operating position over said vessel.

11. The improvement of claim 10, further characterized by (a) said first discharge outlet having an outwardly facing annular sealing collar, (b) said controllably movable member comprising a tubular member having an annular collar at its outer end for sealing engagement with said sealing collar, and (c) spring means interposed between said actuating cylinder and said controllably movable member.

12. The improvement of claim 9, further characterized by (a) said first discharge outlet including normally closed valve means therein, (b) said quick-disconnect coupling means including means operative upon coupling automatically to open said valve means.

13. The improvement of claim 12, further characterized by (a) said valve means comprises a pivoting member, and (b) said quick-disconnect coupling means including a member engageable with said pivoting member to open said valve means.

14. In a cooling system for an electric arc furnace having a roof with upper and lower walls forming a chamber and a delta, and cooling means for said roof and delta, the improvement characterized by (a) the cooling means for said roof comprising spray cooling means discharging coolant sprays on said lower wall, (b) a peripheral catchment for collecting spent spray coolant from said roof, (c) a discharge outlet leading from said roof and communicating with said catchment, (d) forced circulation cooling means for said delta including a cooling coil for the passage of cooling water and a cooling coil outlet, (e) a discharge conduit connected to said coil outlet and extending through said roof to and into said discharge outlet, (f) said discharge conduit having its discharge end within said discharge outlet for the discharge of its coolant thereinto.

15. The cooling system of claim 14, further characterized by (a) said discharge conduit extends along the upper wall of said roof, within said chamber.

* * * * *